United States Patent [19]

Engler et al.

[11] 4,210,615

[45] Jul. 1, 1980

[54] MANUFACTURE OF THERMOPLASTICS FIBRIDS

[75] Inventors: Peter Engler, Frankenthal; Otto Nagel, Neustadt, both of Fed. Rep. of Germany; Leo Unterstenhöfer, deceased, late of Limburgerhof, Fed. Rep. of Germany, by Ilse Unterstenhöfer, heiress-at-law; Hans Frielingsdorf, Bad Durkheim, Fed. Rep. of Germany; Heinz Berbner, Moerlenbach, Fed. Rep. of Germany; Heinz Mueller-Tamm, Ludwigshafen, Fed. Rep. of Germany; Dieter Stoehr, Mutterstadt, Fed. Rep. of Germany

[73] Assignee: BASF Aktiengesellschaft, Ludwigshafen, Fed. Rep. of Germany

[21] Appl. No.: 645,660

[22] Filed: Dec. 31, 1975

Related U.S. Application Data

[63] Continuation-in-part of Ser. No. 472,828, May 23, 1974, abandoned.

[30] Foreign Application Priority Data

May 23, 1973 [DE] Fed. Rep. of Germany ..... 2326143

[51] Int. Cl.² ..... B01J 2/06

[52] U.S. Cl. ..... 264/11; 264/13

[58] Field of Search ..... 264/11, 12, 13

[56] References Cited

U.S. PATENT DOCUMENTS

| | | | |
|---|---|---|---|
| 3,042,970 | 7/1962 | Terenzi | 264/11 |
| 3,743,272 | 7/1973 | Nowotny et al. | 264/69 |
| 3,770,856 | 11/1973 | Ueki et al. | 264/13 |
| 3,914,354 | 10/1975 | Ueki et al. | 264/13 |
| 3,937,772 | 2/1976 | Urban | 264/12 |
| 4,013,744 | 3/1977 | Kuerten et al. | 264/14 |

FOREIGN PATENT DOCUMENTS

| | | |
|---|---|---|
| 2326143 | 5/1973 | Fed. Rep. of Germany . |
| 1142253 | 2/1969 | United Kingdom . |

*Primary Examiner*—Donald J. Arnold
*Assistant Examiner*—James R. Hall
*Attorney, Agent, or Firm*—Keil & Witherspoon

[57] ABSTRACT

A process for the manufacture of thermoplastics fibrids, in which a solution of the thermoplastics material is fed to an impulse exchange chamber, where it is cooled so as to cause precipitation of the thermoplastics material, while it is subjected to a field of turbulent shear forces caused by the introduction of a gaseous or liquid medium into the said impulse exchange chamber.

8 Claims, 2 Drawing Figures

MANUFACTURE OF THERMOPLASTICS FIBRIDS

Figure 1:
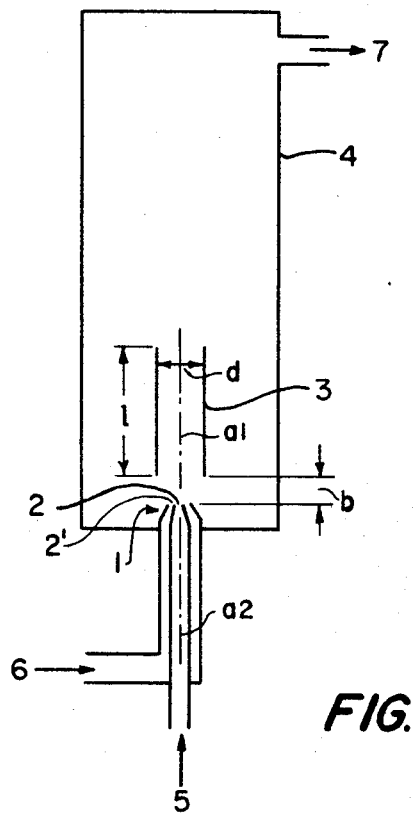

This application is a continuation-in-part of copending application Ser. No. 472,828 filed May 23, 1974, now abandoned.

This invention relates to a process for the manufacture of thermoplastics fibrids by shredding a solution of a thermoplastic in a zone of shear.

A large number of processes have been proposed for the manufacture of staple fibers and fibrids of thermoplastics, for example the aerodynamic spinning process. In this process, the thermoplastics material is melted either in a worm extruder or in a pressurized container and is fed to the fiber-forming station through heated pipes. There a high-speed stream of gas or vapor is directed onto the extruded melt at a specific angle.

German Published Application No. 1,469,120 discloses a process for the manufacture of a suspension of fibrids in which a solution of a synthetic organic polymer is dispersed in a precipitant for the polymer and the polymer precipitates under the action of high shear forces.

However, the prior art processes are not free from drawbacks, since either the said processes cause formation of powdery or crumblike particles in addition to the fibrids or they require the use of large amounts of gaseous medium. The prior art processes make use of expensive apparatus and are thus frequently not economical. The fibers obtained show a broad spectrum of dimensions. Those processes which provide fibrids in the desired size distribution have, however, the drawback that the resulting fibrids have only a relatively small specific surface area.

It is an object of the present invention to provide a process of the above kind in which the drawbacks of the prior art processes are substantially obviated and in which fibrids are produced which are similar to natural fibers, e.g. ground cellulose, as regards morphology and size and which have a large specific surface area.

This object is achieved by the present invention by passing a homogeneous solution of a thermoplastic in an organic solvent which is a solvent for said plastic only at elevated temperature, through a nozzle into a zone having the form of an impulse exchange chamber, in which the homogeneous solution is cooled such that the thermoplastic precipitates and in which a turbulent field of shear forces exists, this being produced by the introduction of a jet of a liquid medium into the impulse exchange chamber at a velocity of at least 5 m/s.

Suitable thermoplastics are all polymers from which fibrids can be prepared, for example polyolefins, polyamides, polymers of styrene and polymers of substituted styrenes. Particularly suitable are polyolefins such as polyethylene and polypropylene. The density of the polyethylene may be from 0.915 to 0.965 g/cm$^3$. The melt index of the polyethylene is from 0.01 to 100 g/10 min. (190° C./2.16 kg), as determined according to ASTM D 1238-65 T. Suitable polyethylenes are commercially available. They are prepared by well-known high-pressure and low-pressure polymerization processes. The polypropylene has an intrinsic viscosity (measured at 130° C. in decalin) of from 1.5 to 8 dl/g. Alternatively, polyvinyl chloride or chlorinated polyethylene may be used for the manufacture of the fibrids. Another important process is the manufacture of fibrids from copolymers of ethylene. Suitable ethylene copolymers are well known. They are prepared by copolymerization of ethylene with other ethylenically unsaturated compounds by the high-pressure polymerization process. As examples there may be mentioned copolymers of ethylene and vinyl acetate, copolymers of ethylene and n-butyl acrylate, copolymers of ethylene and acrylic acid and copolymers containing polymerized units of a number of ethylenically unsaturated comonomers such as copolymers of ethylene, acrylic acid and vinyl acetate or copolymers of ethylene, acrylic acid and t-butyl acrylate. It is of course also possible to prepare fibrids from mixtures of thermoplastics, for example from a mixture of high-pressure and low-pressure polyethylenes in a ratio of 1:1 or a 4:1 mixture of high-pressure polyethylene and an ethylene/vinyl acetate copolymer having a vinyl acetate content of 15% by weight.

The thermoplastics are dissolved in an organic solvent. Suitable solvents are only those in which the thermoplastic is soluble at elevated temperatures and separates out on cooling. It is important that the polymer should precipitate at a temperature which is below that at which the homogeneous solution is prepared. The temperature at which precipitation begins depends on the solvent, the thermoplastic and the concentration of the latter. We prefer to prepare the homogeneous solution of the thermoplastic, or the mixture of molten thermoplastic with a solvent, at temperatures above the crystallite melting point or the softening point of the polymer. The temperature of the solutions is in the range of from 50° to 300° C., preferably from 100° to 200° C.

Suitable solvents are for example hydrocarbons such as pentane, hexane, heptane, isooctane, n-octane, decalin, tetralin, cyclohexane and aromatic hydrocarbons such as benzene, xylene, toluene, chlorobenzene and halohydrocarbons such as ethylene chloride, 1,2-dichlorotetrafluoroethane and hexachloroethane. Other suitable solvents are acetone, cyclohexanone, methyl ethyl ketone and tetrahydrofuran. It is advantageous, in some cases, to use mixtures of said solvents. The ratio of thermoplastic to solvent may be varied within wide limits. The concentration of the polymer in the organic solvent may be from 1 to 30%. Advantageously thermoplastic solutions are used in which from 3 to 15% by weight of thermoplastic is dissolved homogeneously.

In a preferred embodiment of the process of the invention, the aforementioned organic solvents are supplemented by expanding agents. By expanding agents we mean those gaseous or liquid substances which are used as foaming agents in the known processes for the manufacture of foams. Up to 75% and preferably from 20 to 60% of the organic solvent may be replaced by an expanding agent or mixture of expanding agents.

Suitable expanding agents are inert gases such as nitrogen, carbon dioxide and inert liquids such as water and low-boiling hydrocarbons and halohydrocarbons. The boiling points of the expanding agents are at least 25° C. and preferably from 25° to 150° C. below the boiling point of the solvents. That is to say, these compounds have a high vapor pressure at room temperature. Examples of suitable expanding agents are aliphatic and olefinic hydrocarbons of from 1 to 4 carbon atoms such as methane, ethane, propane, butane and ethylene, propylene and butene. It is also possible to use hydrocarbons containing from 5 to 7 carbon atoms and having at least two lateral methyl groups and boiling points between −10° C. and 60° C. Examples thereof are isopentane, isohexane and 2,2-dimethylbutane. Particularly suitable halohydrocarbons are those having 1 or 2 carbon atoms such as methyl chloride, dichlorodifluoromethane, dichloromethane, fluorotrichloromethane, monofluorochloromethane, 1,2,2-trifluorotrichloroethane and 1,1,2,2-tetrafluorodichloroethane. The said expanding agents are such as are used, for example, as foaming agents in the manufacture of foams. Some of these expanding agents may be used alone as solvents, as in the case of dichloromethane and pentane. In other cases it is possible to replace the organic solvent used within wide limits by one or more of said expanding agents.

The homogeneous solution of thermoplastic in an organic solvent is prepared either batchwise in a stirred autoclave or possibly, in the case of higher boiling solvents, in an open vessel, or it is prepared continuously in a single-worm or twin-worm extruder. When preparing the homogeneous polymer solution, we generally operate at pressures above the pressure of the solvent at the solution temperature with the result that the solvent remains liquid under these conditions. By the pressure of the solvent we mean the vapor of the solvent above the dissolved or molten thermoplastic. When dissolution is complete, the resulting homogeneous solution is passed through a two-fluid nozzle into the impulse exchange chamber where the thermoplastic is shredded.

Suitable two-fluid nozzles have an opening for the solution which is disposed concentrically around the outlet for the jet of liquid medium. The opening for the solution may be an annular gap having a width of from 0.2 to 2.0 mm, or a plurality of concentrically arranged orifices each having a diameter of from 0.3 to 5 mm. The number of concentrically arranged orifices can range from 2 to 20. The nozzle orifice for the jet of liquid medium arranged concentrically within the orifice(s) for the solution usually has a diameter of from 1 to 10 mm; the distance of the annular gap or the concentrically arranged orifices from the orifice for the jet of liquid medium is from 0.3 to 20 mm. Shredding of the thermoplastic in solution leaving the orifice or orifices of the nozzle is carried out under the influence of shearing forces exerted on a small volume. The said solution is fed to a zone of high energy dissipation, in which the thermoplastic is shredded to fibrids of the desired size. "Energy dissipation" is generally defined as the change from one kind of energy to another.

In order to produce high shear stress in a small volume and thus high energy dissipation, it has been found advantageous to use an apparatus consisting of a two-fluid nozzle projecting into a tank in which there is disposed an impulse exchange chamber which is small compared with the volume of the tank. The impulse exchange chamber is arranged with its longitudinal axis in line with the axis of the nozzle and at such a short distance from the nozzle orifices that it accommodates the media emerging from said orifices (homogeneous solution of thermoplastic and liquid medium). The distance of the inlet of the impulse exchange chamber from the nozzle is less than twice the mean diameter of the impulse exchange chamber, preferably from 0.1 to 1 time the mean diameter.

The high-speed jets of liquid medium are also directed toward the impulse exchange chamber disposed in the tank. The velocity of the jets of liquid medium directed toward the impulse exchange chamber is at least 5 m/s and is preferably from 10 to 100 m/s. If desired, jet velocities of up to 500 m/s may be used.

The impulse exchange chamber is a small tubular chamber which is usually cylindrical. Virtually all of the impulse energy of the propulsive jets of liquid medium is dissipated within this chamber. The two-fluid nozzle and impulse exchange chamber are arranged in a tank. The impulse exchange chamber generally has a constant cross-section. Alternatively, it may be of a shape such that its cross-section increases in the direction of flow. Usually, cylindrical tubes are used. The impulse exchange chamber is generally designed so as to have a length which is from 2 to 30 times its diameter. The impulse exchange chamber should have a mean inlet diameter which is from 2 to 20 times the diameter of a circular area equal to the total area of the nozzle orifice from which the solution of thermoplastic emerges. In our invention, the energy dissipation densities achieved in the impulse exchange chamber are from 10 to $10^6$ kw/m$^3$. The tank is filled with liquid medium, i.e., the impulse exchange chamber and the two-fluid nozzle are surrounded by liquid medium. The term "energy dissipation density" as used in the art means dissipated energy which acts on a defined volume—in the instant case a defined volume of solution. Dissipation density is measured in kilowatts/cubic meter or, better yet in watts/liter; this latter relationship follows from the fact that one liter corresponds to one cubic-decimeter or 0.001 cubic meter so that one watt/liter corresponds to one kilowatt/cubic meter.

The process of the invention is carried out industrially in the manner described below with reference to the accompanying FIGS. 1 and 2. For the sake of clarity, the nozzles and the impulse exchange chamber shown in the figures are drawn on a larger scale than the tank. The reference numerals in the figures have the following meanings:

1 is the nozzle collectively; it has an outlet
2 for the liquid medium and another outlet
2' for the homogeneous solution of thermoplastic,
3 is the impulse exchange chamber,
4 is the tank,
5 is the inlet for the liquid medium and
6 is the inlet for the homogeneous solution of the thermoplastic,
7 is the outlet for the fibrids;
a1 is the longitudinal axis of impulse exchange chamber 12,
a2 is the longitudinal axis of nozzle 1,
b is the distance from the nozzle to the chamber inlet,
l is the length of the chamber, and
d is the diameter of the chamber.

Figure 2:
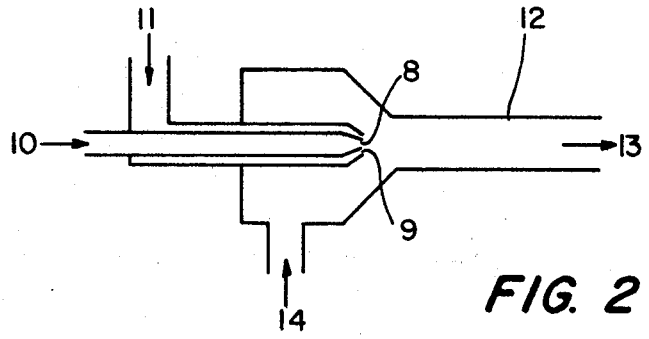

FIG. 2 shows a different embodiment of apparatus according to the invention. In this figure, 8 is the outlet for liquid medium,
9 is the outlet for the solution of the thermoplastic,
10 is the inlet for the liquid medium,
11 is the inlet for the solution of the thermoplastic,
12 is the impulse exchange chamber which is connected with the tank,
13 is the outlet for the fibrids.
14 denotes another inlet for the liquid medium.

In this case, shredding of the thermoplastic is effected in impulse exchange chamber 12.

The turbulent field of shearing forces acting on the solution of thermoplastic in the impulse exchange chamber is in a liquid medium. This means that the impulse exchange chamber is filled with the liquid medium. Suitable liquid media are liquids in which the polymers do not dissolve or the solvents in which the polymer is dissolved. It is particularly advantageous to use water as the liquid medium. The fibrids are subsequently suspended in water for treatment with, say, substances rendering them hydrophilic.

The temperature of the liquid medium depends on the temperature of the solution of thermoplastic and on the type and size of fibrids to be produced. It is important that the solution of thermoplastic is cooled quickly to enable the dissolved thermoplastic to precipitate. The temperature of the liquid medium is generally between 20° and 200° C. and preferably between 30° and 150° C. below the temperature of the solution of thermoplastics.

According to the process of the invention, fibrids are formed which have lengths, in the range from 100 to 50,000 μm, preferably from 200 to 10,000 μm, and a thickness in the range of 1 to 1000 μm, preferably from 10 to 500 μm. The ratio of thickness to length is at least 10, preferably between 20 and 100. The specific surface area is in the range from 1 to 70 $m^2$/gram. The Schopper-Riegler freeness is from 6° to 15° SR (determined according to Merkblatt FAK V 107 Verein der Zellstoff-Papier-Chemiker und Ingenieure). The fibrids thus obtained are of various shapes and sizes depending on the conditions of the process and on the concentration of polymer in the solvent and are swollen with solvent to a greater or lesser degree. The fibrids must be worked up and treated further depending on the use to which they are to be put.

The fibrids produced in the process of the invention are used, for example, in the manufacture of a wide variety of non-wovens. Typical examples are webs of paper and non-woven fabrics. In the manufacture of paper and non-woven fabrics, the fibrids prepared in the present invention may, in conjunction with natural and synthetic fibers of all kinds, contribute to the texture or act as bonding fibers, depending on their shape and size, particularly fine fibrids being required for the latter purpose. The fibrids improve the strength of the webs when they are subjected to suitable heat treatments when the webs are being made.

Since non-wovens are frequently manufactured by wet-processes involving the use of very dilute aqueous suspensions, the polymeric fibrids must have a hydrophilic surface if they are to be uniformly dispersed in the suspension and thus in the resulting non-wovens. It has been found particularly advantageous to carry out the process of the invention in such a manner that substances capable of rendering the fibrids hydrophilic can be added during the shredding operation. These substances can then act on the natant fibers when their surface area is at its largest, without having to pass through long diffusion paths. However, this does not exclude the possibility of adding such agents directly to the polymer solution or, at a subsequent point, to the fibrids themselves during working up.

The invention is illustrated below with reference to the following Examples.

EXAMPLE 1

A linear polyethylene having a density of 0.960 g/$cm^3$, a melt index of 5 (190° C./2.16 kg) and a melting point of 132° C. is dissolved in cyclohexane in a stirred autoclave at a temperature of 155° C. and a pressure of 6 atmospheres. A 1% homogeneous solution is produced which is then passed through a heated pipeline to a fibrid producer of the kind shown diagrammatically in FIG. 1. The solution of thermoplastic is extruded through a nozzle having a circle of orifices each of a diameter of 0.7 mm. A tube having a length of 15 cm and a diameter of 2.5 cm is situated at a distance of 8 mm from said nozzle. A water jet is directed toward this tube, which serves as impulse exchange chamber, at a velocity of 34 m/s from an orifice 1 having a diameter of 2 mm. The water contains a surfactant (a commercially available adduct of ethylene oxide and propylene oxide) in a concentration of 0.1% by weight, based on the water, and has a temperature of 25° C. In this way, the solution of thermoplastic is suddenly cooled at the point of fibrid formation. The resulting entangled fibrids or bundles of fibrids swollen with cyclohexane are mechanically disentangled in a water/cyclohexane emulsion at a pulp density of 0.4% for 3 minutes by mechanical high-frequency treatment by the method proposed by P. Willems (see DECHEMA Monographie, Vol. 28 (1956), pp. 173–190). The slurry of fibrids is then distilled at atmospheric pressure and at temperatures of up to 100° C. to remove the solvent and is then again subjected to mechanical high-frequency treatment as above for 2 minutes to disentangle any slight fibrid agglomerations which may have formed during distillation.

The fibrids thus produced are very finely fibrillated and are thin and crimped. Some of the individual microfibrils converge on each other in the longitudinal direction to form thicker single fibrids. The fibrid diameter is from 5 to 50 μm. The lengths of the fibrids are between 350 and 1,000 μm. The fibrids have an appearance very similar to cellulose fibers.

Due to the high velocity of the jet of water leaving the nozzle, a high energy dissipation density of about 1,600 kw/$m^3$ is achieved in a very small volume within the impulse exchange chamber. In this way fibrids having a large specific surface area are produced. In this case, nitrogen adsorption measurements gave a value of about 30 $m^2$/g.

EXAMPLE 2

Example 1 is repeated except that the solution of thermoplastic is extruded through a nozzle having a circle of six orifices each of a diameter of 0.7 mm which are arranged concentrically around the outlet through which the liquid medium emerges, the distance of the orifices from the orifice for the jet of liquid medium is 1 mm and the water temperature is 30° C.

The fibrids thus produced are very finely fibrillated and have an appearance very similar to cellulose fibers.

EXAMPLE 3

Example 2 is repeated except that the solution of thermoplastic used is a 5% solution in cyclohexane prepared at a temperature of 145° C. and a pressure of 4.5 atmospheres, and that the velocity of the water jet is 22 m/s. There are obtained fibrids having thicknesses of from 30 to 250 μm and lengths of from 400 to 1,600 μm. The energy dissipation density in the impulse exchange chamber is 500 kw/$m^3$ and the specific surface area of the fibrids is about 10 $m^2$/g.

EXAMPLE 4

Example 3 is repeated except that a 10% solution in cyclohexane is prepared at a temperature of 185° C. and a pressure of 10 atmospheres. The energy dissipation density is 1,600 kw/$m^3$. There are obtained fibrids having diameters of from 10 to 100 μm and lengths of from 400 to 2,000 μm.

Similar results are obtained when the turbulent field of shearing forces is produced not in water but in cyclohexane.

EXAMPLE 5

Example 2 is repeated except that a 10% solution is cyclohexane is prepared which contains 3% by weight of water, based on the weight of solvent. The resulting fibrids are relatively long and have very fine fibrillations. They show, in the longitudinal direction, relatively thick agglomerates of fine fibrids and also flatter structures. The fibrid diameter ranges from 10 to 100 μm and the lengths of the fibrids range from 400 to 5,000 μm. Very similar fibrids may be prepared by adding to the polymer solution not water but 0.05% by weight of nitrogen.

EXAMPLE 6

A polyethylene having a density of 0.96 g/cm$^3$, a melt index of 5 (190° C./2.16 kg) and a melting point of 132° C. is dissolved in a solvent mixture consisting of 79% by weight of cyclohexane and 21% by weight of pentane, in a stirred autoclave at a temperature of 155° C. and a pressure of 9 atmospheres. There is formed a 3.3% polymer solution which is fed to the fibrid producer of Example 2 through a heated pipeline. The velocity of the water jet is 22 m/s and its temperature is 25° C. The energy dissipation is 500 kw/m$^3$.

The fibrids, swollen with solvent, are subjected to a mechanical high-frequency treatment by the method proposed by P. Willems (see DECHEMA Monographie, Vol. 28 (1956), pp. 173–190) for 3 minutes in the presence of 3% by weight, based on the polymer, of a surface-active substance and at a pulp density of 1.1% by weight. The solvent is then removed at a pressure of 100 mm of Hg and temperatures of up to 60° C., whereupon the fibrids are again subjected to said mechanical high-frequency treatment. The resulting fibrids are finely fibrillated and ramified. The finest ramifications have thicknesses of less than 10 μm, whilst the fibrids themselves have diameters of from 10 to 80μ and lengths ranging from 300 to 4,000 μm.

EXAMPLE 7

A high molecular weight polyethylene having a density of 0.952 g/cm$^3$, a melt index of 2 (190° C./2.16 kg) and a crystallite melting point of 136° C. is dissolved in cyclohexane in a stirred autoclave at a pressure of 7 atmospheres and a temperature of 165° C. There is produced a 3% solution which is fed to the fibrid producer described in Example 2 through a heated pipeline. The velocity of the water jet is 22 m/s and its temperature is 25° C. The enery dissipation is 500 kw/m$^3$.

The fibrids obtained are swollen with solvent. The entangled fibrids and bundles thereof are subjected, for 3 minutes, to a mechanical high-frequency treatment by the method proposed by P. Willems (see DECHEMA Monographie, Vol. 28 (1956), pp. 173/190) in the presence of 5% by weight (based on the thermoplastic) of a surfactant and at a pulp density of 1.1% by weight. The solvent is then removed as described in Example 5. There are obtained fibrids which are very finely fibrillated. The fibrid diameters are from 5 to 20 μm and the lengths of the fibrids range from 2,000 to 6,000 μm.

EXAMPLE 8

Branched-chain polyethylene having a density of 0.918 g/cm$^3$, a melt index of 20 (190° C./2.16 kg) and a melting point of 105° C. is melted in a twin-worm extruder. The extruder worms have a length/diameter ratio of 34 and a diameter of 2 inches. Pentane is fed to the polyethylene melt by a metering pump such that the extrudate consists of a homogeneous solution consisting of 84% by weight of pentane and 17% by weight of polyethylene. The homogeneous solution resides in the extruder for about 3 minutes at a temperature of 125° C. and is then fed to the fibrid producer of Example 2. The velocity of the water jet is 40 m/s and its temperature is 18° C. The energy dissipation is 2,500 kw/m$^3$. There are obtained fibrids, which are subjected, for 3 minutes, to a mechanical high-frequency treatment as proposed by P. Willems (see DECHEMA Monographie, Vol. 28 (1956) pp. 173–190) in the presence of a water/pentane emulsion and a pulp density of 1.7% by weight. The pentane is distilled off at temperatures of up to 45° C. The fibrids are finely fibrillated and have a foam-like structure. The individual fibrids show fine ramifications and are slightly crimped. Their thicknesses range from about 10 to 150 μm and their lengths from 250 to 3,000 μm. The specific surface area of the fibrids is 1.1 m$^2$/g.

EXAMPLE 9

Polyethylene having a density of 0.918 g/cm$^3$, a melt index of (190° C./2.16 kg) and a melting point of 105° C. is melted in the extruder described in Example 8. Cyclohexane is fed to the polyethylene melt by means of a pump at such a rate that the extruder worm feeds a homogeneous solution containing 60% by weight of cyclohexane and having a temperature of 190° C. to the fibrid producer illustrated in FIG. 1. In addition, when the polyethylene has been melted, nitrogen is added thereto at a pressure of 10 atmospheres and at a rate of 9 l/kg (STP). The pressure built up upstream of the fibrid producer by the extruder is 27 atmospheres and the velocity of the water jet is 40 m/s. Energy dissipation is 2,500 kw/m$^3$ and the water temperature is 55° C. There are produced fibrids having the character of individual fibrids of solidified polyethylene and having highly cracked surfaces and a slightly flat appearance.

EXAMPLE 10

A 13% solution in pentane of a branched-chain polyethylene having a density of 0.918 g/cm$^3$, a melt index of 1.5 (190° C./2.16 kg) and a melting point of 108° C. is produced in a stirred autoclave at a temperature of 90° C. and a pressure of 4.5 atmospheres and is then fed to the fibrid producer described in Example 2. The velocity of the water jet is 10 m/s and its temperature is 26° C. (energy dissipation 40 kw/m$^3$). The water contains a surface-active substance in a concentration of 0.1% by weight. The resulting pentane-containing fibrids are disentangled in a water/pentane mixture at a pulp density of 3.5% by weight by subjection, for 3 minutes, to a mechanical high-frequency treatment as proposed by P. Willems (see DECHEMA Monographie, Vol. 28 (1957), pp. 173–190). The remaining solvent is then distilled off at temperatures of up 40° C. and the residue is again subjected to said mechanical high-frequency treatment. There are obtained fibrids which are finely fibrillated. They are similar to the well-known spruce/-cellulose fibrids. The thicknesses of the fibers range from 10 to 60 μm and their lengths from 250 to 1,500 μm. During the manufacture of the fibrids, the energy dissipation in the impulse exchange tube is 40 kw/m$^3$. The specific surface area of the fibrids is 64 m$^2$/g.

Similar results are obtained if a 5% solution of the same polymer in pentane or a 10% solution of the polymer given in Example 8 in pentane is used.

If the mechanical high-frequency treatment proposed by P. Willems (see DECHEMA Monographie, Vol. 28 (1956), pp. 173–190) is omitted after distillation, the fibrids produced are longer, having lengths of up to about 10 mm. These fibrids are particularly suitable for the manufacture of non-woven webs.

EXAMPLE 11

Example 10 is repeated except that a 10% solution of the thermoplastic is prepared and that the velocity of the water jet is 22 m/s and its temperature is 50° C. (energy dissipation 500 kw/m$^3$). There are obtained long fibrids of a foamy structure, which are very uniform. They are suitable for the manufacture of coarser non-wovens, to which they impart resilient, flexible and soft characteristics. The diameters of these fibrids depend on the dimensions of the outlet orifices of the fibrid producer. When said orifices have a diameter of 1 mm, the thickness of the fibrids is from 2 to 3 mm.

EXAMPLE 12

The procedure described in Example 2 is followed. The thermoplastic used is a highly crystalline propylene homopolymer having a density of 0.908 g/cm$^3$ and a melt index of 2.5 (190° C./2.16 kg), this being dissolved in cyclohexane in a stirred autoclave at a temperature of 160° C. and a pressure of 6 atmospheres. There is obtained a 3% solution which is then fed to the fibrid producer. The velocity of the water jet is 34 m/s and its temperature is 25° C. The energy dissipation is 1,600 kw/m$^3$. The resulting entangled fibrids swollen with cyclohexane are disentangled in a water/cyclohexane emulsion at a pulp density of 1% by subjection, for 3 minutes, to a mechanical high-frequency treatment. To the emulsion there is added 1% (based on the fibers) of a commercial surfactant (adduct of ethylene oxide and propylene oxide). The slurry of fibrids is heated at temperatures of up to 60° C. under reduced pressure to distil off the cyclohexane. The fibrid suspension is then again treated for 1 minute with said mechanical high-frequency treatment. There are obtained fibrids which are very finely fibrillated. The thickness of the fibers is from 5 to 50 μm and their lengths range from 250 to 3,000 μm.

EXAMPLE 13

Standard polystyrene having a density of 1.05 g/cm$^3$ and a dimensional stability of 101° C. (measured by the Vicat method, DIN 53,460) is fed to a twin-worm extruder in the form of granules. Isobutyl alcohol is fed, as solvent, to the polystyrene melt by means of a metering pump such that the extrudate consists of a homogeneous solution consisting of 95 parts by weight of isobutyl alcohol and 5 parts by weight of polystyrene. The temperature of the solution is 175° C. On leaving the extruder, the homogeneous solution is fed to the fibrid producer of Example 2. The nozzle orifices have a diameter of 0.7 mm. The velocity of the water jet is 34 m/s and its temperature is 25° C. (energy dissipation 1,600 kw/m$^3$). There are obtained very fine fibrids, which are disentangled in a water/isobutyl alcohol mixture for 3 minutes by means of a mechanical high-frequency process. The disentangled fibrids have a thickness of from 50 to 500 μm and a length of from 250 to 3,000 μm. The specific surface area, determined by the BET method, has a value of about 150 m$^2$/g of fibrids.

EXAMPLE 14

Linear polyethylene having a density of 0.960 g/cm$^3$, a melt index of 5 (190° C., 2.16 kg) and a melting point of 132° C. is dissolved in cyclohexane in a stirred autoclave at a temperature of 140° C. and a pressure of 3.5 atmospheres. The resultant homogeneous 10% solution is passed through a heated pipeline to an arrangement as shown diagrammatically in FIG. 1. The opening for the polymer solution consists of an annular gap having a width of 1 mm and is disposed concentrically around the outlet for the jet of liquid medium at a distance of 3 mm. An impulse exchange chamber having a length of 150 mm and a diameter of 25 mm is situated at a distance of 10 mm from said nozzle. A water jet at a velocity of 7 m/s is directed toward said chamber from orifice 1 having a diameter of 2 mm. The temperature of the water is 25° C., so that the solution of thermoplastic is suddenly cooled in the chamber. The resulting fibrids which are swollen with cyclohexane are discharged through outlet 7 in the water-cyclohexane emulsion and then freed from cyclohexane by drying at 70° C. The fibrids have a length of 400–5,000 μm, a thickness of 20 μm–150 μm, a specific surface area of 15 m$^2$/g and a freeness of 9° (Schopper-Riegler).

If, under otherwise identical conditions, the velocity of the water jet is reduced to 1 m/s, long ribbons are obtained in the impulse exchange chamber which cannot be processed into finely fibrillated fibrids by a mechanical aftertreatment, the resulting sheet-like agglomerates having a specific surface area of 0.5 m$^2$/g. A Schopper-Riegler freeness cannot be determined.

We claim:

1. A process for the manufacture of thermoplastic fibrids having a length of from 100 to 50,000 μm, a thickness of from 1 to 1,000 μm, and a ratio of length to thickness of at least 10, which comprises:
   1. dissolving a thermoplastic polymer in an organic solvent which is a solvent for said thermoplastic polymer only at elevated temperature;
   2. ejecting said polymer solution through the outer aperture means of a concentric nozzle at a temperature of from 50° to 300° C.;
   3. ejecting, simultaneously with the solution ejection of step 2, a jet of water at a velocity of from 5 m/s to 500 m/s and at a temperature between 20° and 200° C. below the temperature of the ejected solution, through a central orifice of said concentric nozzle, so that said solution is cooled by said water to a temperature below said elevated temperature of step 1, said central orifice having a diameter of from 1 to 10 mm while said outer aperture means which is disposed concentrically around said central orifice is in the form of an annular gap having a width of from 0.2 to 2.0 mm;
   4. directing the solution and the water from said concentric nozzle into a tubular impulse exchange chamber having a length of from 2 to 30 times the mean inlet diameter of said chamber, said polymer solution being comminuted in said chamber by impingement with said water jet and under the influence of shearing forces so as to yield an energy dissipation density of 10 to 10$^6$ watts/liter, said chamber being filled with said water and being positioned so that the longitudinal axis of the chamber is in line with the axis of the nozzle, the distance from the nozzle to the impulse exchange chamber inlet being less than twice the mean inlet diameter of the impulse exchange chamber and the chamber having a mean inlet diameter of from 2 to 20 times the diameter of a circular area equal to the total area of the nozzle aperture means from which the polymer solution emerges; and 5. collecting the produced fibrids after their emergence from the impulse exchange chamber.

2. A process as set forth in claim 1 wherein the distance from the nozzle to the impulse exchange chamber inlet is from 0.1 to 1 times the mean diameter of the impulse exchange chamber.

3. A process as set forth in claim 1 wherein said thermoplastic polymer is selected from the group consisting of polyethylene and polypropylene.

4. A process as set forth in claim 1 wherein said organic solvent is selected from the group consisting of pentane, hexane, heptane, isooctane, n-octane, decalin, tetralin, cyclohexane, benzene, xylene, toluene, chlorobenzene, ethylene chloride, 1,2-dichlorotetrafluoroethane, hexachloroethane, acetone, cyclohexanone, methyl ethyl ketone, and tetrahydrofuran.

5. A process as set forth in claim 1 wherein the concentration of thermoplastic polymer in said solution is from 1 to 30%.

6. A process as set forth in claim 1 wherein the organic solvent is supplemented before dissolving the thermoplastic polymer, by an expanding agent selected from the group consisting of gaseous or liquid substances, with the ratio, by weight, of expanding agent to organic solvent being up to 3:1.

7. A process as set forth in claim 6 wherein said expanding agent consists of at least one component selected from the group consisting of methane, ethane, propane, butane, ethylene, propylene, butene, isopentane, isohexane, 2,2-dimethylbutane, methyl chloride, dichlorodifluoromethane, dichloromethane, fluorotrichloromethane, monofluorochloromethane, 1,2,2-trifluorotrichlorethane and 1,1,2,2-tetrafluorodichloroethane.

8. A process for the manufacture of thermoplastic fibrids having a length of from 100 to 50,000 μm, a thickness of from 1 to 1,000 μm, and a ratio of length to thickness of at least 10, which comprises:

1. dissolving a thermoplastic polymer in an organic solvent which is a solvent for said thermoplastic polymer only at elevated temperature;
2. ejecting said polymer solution through the outer aperture means of a concentric nozzle at a temperature of from 50° to 300° C.;
3. ejecting, simultaneously with the solution ejection of step 2, a jet of water at a velocity of from 5 m/s to 500 m/s and at a temperature between 20° and 200° C. below the temperature of the ejected solution, through a central orifice of said concentric nozzle, so that said solution is cooled by said water to a temperature below said elevated temperature of step 1, said central orifice having a diameter of from 1 to 10 mm while said outer aperture means which is disposed concentrically around said central orifice is in the form of a plurality of concentrically arranged openings having a diameter of from 0.3 to 5 mm;
4. directing the solution and the water from said concentric nozzle into a tubular impulse exchange chamber having a length of from 2 to 30 times the mean inlet diameter of said chamber, said polymer solution being comminuted in said chamber by impingement with said water jet and under the influence of shearing forces so as to yield an energy dissipation density of 10 to $10^6$ watts/liter, said chamber being filled with said water and being positioned so that the longitudinal axis of the chamber is in line with the axis of the nozzle, the distance from the nozzle to the impulse exchange chamber inlet being less than twice the mean inlet diameter of the impulse exchange chamber and the chamber having a mean inlet diameter of from 2 to 20 times the diameter of a circular area equal to the total area of the nozzle aperture means from which the polymer solution emerges; and
5. collecting the produced fibrids after their emergence from the impulse exchange chamber.

* * * * *